US006712154B2

(12) United States Patent
Cook et al.

(10) Patent No.: US 6,712,154 B2
(45) Date of Patent: Mar. 30, 2004

(54) ISOLATION OF SUBTERRANEAN ZONES

(75) Inventors: Robert Lance Cook, Katy, TX (US); Michael Bullock, Houston, TX (US)

(73) Assignee: Enventure Global Technology, Houston, TX (US)

( * ) Notice: Subject to any disclaimer, the term of this patent is extended or adjusted under 35 U.S.C. 154(b) by 32 days.

(21) Appl. No.: 09/981,916

(22) Filed: Oct. 18, 2001

(65) Prior Publication Data

US 2002/0066576 A1 Jun. 6, 2002

Related U.S. Application Data

(63) Continuation-in-part of application No. 09/440,338, filed on Nov. 15, 1999, now Pat. No. 6,328,113.
(60) Provisional application No. 60/108,558, filed on Nov. 16, 1998.

(51) Int. Cl.[7] ..... E21B 43/14
(52) U.S. Cl. ..... 166/387; 166/50; 166/117.6
(58) Field of Search ..... 166/50, 313, 117.5, 166/117.6, 387, 66.6, 205, 242.6, 242.7

(56) References Cited

U.S. PATENT DOCUMENTS

| | | | |
|---|---|---|---|
| 46,818 | A | 3/1865 | Patterson |
| ,331,940 | A | 12/1885 | Bole |
| ,332,184 | A | 12/1885 | Bole |
| 341,237 | A | 5/1886 | Healey |
| ,519,805 | A | 5/1894 | Bavier |
| ,806,156 | A | 12/1905 | Marshall |
| 958,517 | A | 5/1910 | Mettler |
| 984,449 | A | 2/1911 | Stewart |
| 1,233,888 | A | 7/1917 | Leonard |
| 1,589,781 | A | 6/1926 | Anderson |
| 1,590,357 | A | 6/1926 | Feisthamel |
| 1,880,218 | A | 10/1932 | Simmons |
| 1,981,525 | A | 11/1934 | Price |
| 2,046,870 | A | 7/1936 | Clasen et al. |
| 2,087,185 | A | 7/1937 | Dillom |
| 2,122,757 | A | 7/1938 | Scott |
| 2,160,263 | A | 5/1939 | Fletcher |
| 2,187,275 | A | 1/1940 | McLennan |
| 2,204,586 | A | 6/1940 | Grau |
| 2,214,226 | A | 9/1940 | English |
| 2,226,804 | A | 12/1940 | Carroll |
| 2,273,017 | A | 2/1942 | Boynton |
| 2,301,495 | A | 11/1942 | Abegg |
| 2,447,629 | A | 8/1948 | Beissinger et al. |
| 2,500,276 | A | 3/1950 | Church |
| 2,583,316 | A | 1/1952 | Bannister |
| 2,734,580 | A | 2/1956 | Layne |
| 2,796,134 | A | 6/1957 | Binkley |
| 2,812,025 | A | 11/1957 | Teague et al. |
| 2,907,589 | A | 10/1959 | Knox |
| 3,015,500 | A | 1/1962 | Barnett |
| 3,018,547 | A | 1/1962 | Marskell |
| 3,067,819 | A | 12/1962 | Gore |

(List continued on next page.)

FOREIGN PATENT DOCUMENTS

| | | | |
|---|---|---|---|
| CA | 736288 | 6/1966 | |
| CA | 771462 | 11/1967 | |
| CA | 1171310 | 7/1984 | ..... F16B/13/06 |

(List continued on next page.)

OTHER PUBLICATIONS

Halliburton Energy Services, "Halliburton Completion Products" 1996, Page Packers 5–37, United States of America.

(List continued on next page.)

*Primary Examiner*—Frank Tsay
(74) *Attorney, Agent, or Firm*—Haynes and Boone LLP; Todd Mattingly

(57) ABSTRACT

One or more subterranean zones are isolated from one or more other subterranean zones using a combination of solid tubulars and slotted tubulars.

40 Claims, 4 Drawing Sheets

U.S. PATENT DOCUMENTS

| | | | | |
|---|---|---|---|---|
| 3,104,703 | A | 9/1963 | Rike et al. | |
| 3,111,991 | A | 11/1963 | O'Neal | |
| 3,167,122 | A | 1/1965 | Lang | |
| 3,175,618 | A | 3/1965 | Lang et al. | |
| 3,179,168 | A | 4/1965 | Vincent | |
| 3,188,816 | A | 6/1965 | Koch | |
| 3,191,677 | A | 6/1965 | Kinley | |
| 3,191,680 | A | 6/1965 | Vincent | |
| 3,203,451 | A | 8/1965 | Vincent | |
| 3,203,483 | A | 8/1965 | Vincent | |
| 3,209,546 | A | 10/1965 | Lawton | |
| 3,245,471 | A | 4/1966 | Howard | |
| 3,270,817 | A | 9/1966 | Papaila | |
| 3,297,092 | A | 1/1967 | Jennings | |
| 3,326,293 | A | 6/1967 | Skipper | |
| 3,353,599 | A | 11/1967 | Swift | |
| 3,354,955 | A | 11/1967 | Berry | |
| 3,358,760 | A | 12/1967 | Blagg | |
| 3,358,769 | A | 12/1967 | Berry | |
| 3,364,993 | A | 1/1968 | Skipper | |
| 3,412,565 | A | 11/1968 | Lindsey et al. | |
| 3,419,080 | A | 12/1968 | Lebourg | |
| 3,424,244 | A | 1/1969 | Kinley | |
| 3,477,506 | A | 11/1969 | Malone | |
| 3,489,220 | A | 1/1970 | Kinley | |
| 3,498,376 | A | 3/1970 | Sizer et al. | |
| 3,568,773 | A | 3/1971 | Chancellor | 166/315 |
| 3,665,591 | A | 5/1972 | Kowal | |
| 3,669,190 | A | 6/1972 | Sizer et al. | 166/315 |
| 3,682,256 | A | 8/1972 | Stuart | |
| 3,687,196 | A | 8/1972 | Mullins | 166/217 |
| 3,691,624 | A | 9/1972 | Kinley | 29/523 |
| 3,693,717 | A | 9/1972 | Wuenschel | 166/285 |
| 3,711,123 | A | 1/1973 | Arnold | 285/18 |
| 3,712,376 | A | 1/1973 | Owen et al. | 166/277 |
| 3,746,068 | A | 7/1973 | Deckert et al. | |
| 3,746,091 | A | 7/1973 | Owen et al. | 166/207 |
| 3,746,092 | A | 7/1973 | Land | 166/207 |
| 3,764,168 | A | 10/1973 | Kisling, III et al. | 285/302 |
| 3,776,307 | A | 12/1973 | Young | 166/125 |
| 3,779,025 | A | 12/1973 | Godley et al. | 61/53.52 |
| 3,780,562 | A | 12/1973 | Kinley | 72/479 |
| 3,785,193 | A | 1/1974 | Kinley et al. | 72/393 |
| 3,797,259 | A | 3/1974 | Kammerer, Jr. | 61/53.68 |
| 3,812,912 | A | 5/1974 | Wuenschel | 166/207 |
| 3,818,734 | A | 6/1974 | Bateman | 72/75 |
| 3,866,954 | A | 2/1975 | Slator et al. | |
| 3,885,298 | A | 5/1975 | Pogonowski | |
| 3,887,006 | A | 6/1975 | Pitts | 166/124 |
| 3,893,718 | A | 7/1975 | Powell | |
| 3,898,163 | A | 8/1975 | Mott | |
| 3,915,478 | A | 10/1975 | Al et al. | |
| 3,935,910 | A | 2/1976 | Gaudy et al. | |
| 3,945,444 | A | 3/1976 | Knudson | 175/92 |
| 3,948,321 | A | 4/1976 | Owen et al. | 166/277 |
| 3,970,336 | A | 7/1976 | O'Sickey et al. | |
| 3,977,473 | A | 8/1976 | Page, Jr. | 166/315 |
| 3,997,193 | A | 12/1976 | Tsuda et al. | |
| 4,011,652 | A | 3/1977 | Black | |
| 4,026,583 | A | 5/1977 | Gottlieb | |
| 4,053,247 | A | 10/1977 | Marsh, Jr. | |
| 4,069,573 | A | 1/1978 | Rogers, Jr. et al. | 29/421 R |
| 4,076,287 | A | 2/1978 | Bill et al. | 285/382.4 |
| 4,096,913 | A | 6/1978 | Kenneday et al. | 166/290 |
| 4,098,334 | A | 7/1978 | Crowe | 166/208 |
| 4,152,821 | A | 5/1979 | Scott | |
| 4,190,108 | A | 2/1980 | Webber | 166/202 |
| 4,205,422 | A | 6/1980 | Hardwick | 29/402.13 |
| 4,253,687 | A | 3/1981 | Maples | 285/332 |
| 4,274,665 | A | 6/1981 | Marsh, Jr. | |
| RE30,802 | E | 11/1981 | Rogers, Jr. | |
| 4,304,428 | A | 12/1981 | Grigorian et al. | |
| 4,359,889 | A | 11/1982 | Kelly | 72/62 |
| 4,363,358 | A | 12/1982 | Ellis | 166/212 |
| 4,366,971 | A | 1/1983 | Lula | |
| 4,368,571 | A | 1/1983 | Cooper, Jr. | 29/421 R |
| 4,379,471 | A | 4/1983 | Kuenzel | |
| 4,380,347 | A | 4/1983 | Sable | |
| 4,391,325 | A | 7/1983 | Baker et al. | 166/208 |
| 4,393,931 | A | 7/1983 | Muse et al. | 166/208 |
| 4,402,372 | A | 9/1983 | Cherrington | |
| 4,407,681 | A | 10/1983 | Ina et al. | |
| 4,411,435 | A | 10/1983 | McStravick | 277/9.5 |
| 4,413,395 | A | 11/1983 | Garnier | |
| 4,413,682 | A | 11/1983 | Callihan et al. | 166/382 |
| 4,420,866 | A | 12/1983 | Mueller | 29/421 R |
| 4,421,169 | A | 12/1983 | Dearth et al. | 166/285 |
| 4,423,889 | A | 1/1984 | Weise | 285/39 |
| 4,423,986 | A | 1/1984 | Skogberg | 405/259 |
| 4,429,741 | A | 2/1984 | Hyland | 166/63 |
| 4,440,233 | A | 4/1984 | Baugh et al. | 166/382 |
| 4,444,250 | A | 4/1984 | Keithahn et al. | |
| 4,462,471 | A | 7/1984 | Hipp | |
| 4,469,356 | A | 9/1984 | Duret et al. | |
| 4,473,245 | A | 9/1984 | Raulins et al. | |
| 4,483,399 | A | 11/1984 | Colgate | 166/308 |
| 4,485,847 | A | 12/1984 | Wentzell | 138/89 |
| 4,501,327 | A | 2/1985 | Retz | 166/285 |
| 4,505,017 | A | 3/1985 | Schukei | 29/157.3 R |
| 4,508,129 | A | 4/1985 | Brown | |
| 4,511,289 | A | 4/1985 | Herron | 405/259 |
| 4,519,456 | A | 5/1985 | Cochran | |
| 4,526,232 | A | 7/1985 | Hughson et al. | |
| 4,553,776 | A | 11/1985 | Dodd | 285/212 |
| 4,573,248 | A | 3/1986 | Hackett | |
| 4,576,386 | A | 3/1986 | Benson et al. | |
| 4,590,995 | A | 5/1986 | Evans | 166/127 |
| 4,592,577 | A | 6/1986 | Ayres et al. | |
| 4,605,063 | A | 8/1986 | Ross | 166/216 |
| 4,611,662 | A | 9/1986 | Harrington | 166/339 |
| 4,629,218 | A | 12/1986 | Dubois | 285/176 |
| 4,630,849 | A | 12/1986 | Fukui et al. | |
| 4,632,944 | A | 12/1986 | Thompson | |
| 4,634,317 | A | 1/1987 | Skogberg et al. | 405/259 |
| 4,635,333 | A | 1/1987 | Finch | 29/157.4 |
| 4,637,436 | A | 1/1987 | Stewart, Jr. et al. | 138/89 |
| 4,646,787 | A | 3/1987 | Rush et al. | |
| 4,651,836 | A | 3/1987 | Richards | |
| 4,660,863 | A | 4/1987 | Bailey et al. | |
| 4,662,446 | A | 5/1987 | Brisco et al. | 166/278 |
| 4,669,541 | A | 6/1987 | Bissonnette | |
| 4,682,797 | A | 7/1987 | Hildner | |
| 4,685,191 | A | 8/1987 | Mueller et al. | 29/523 |
| 4,685,834 | A | 8/1987 | Jordan | |
| 4,693,498 | A | 9/1987 | Baugh et al. | |
| 4,711,474 | A | 12/1987 | Patrick | |
| 4,714,117 | A | 12/1987 | Dech | |
| 4,730,851 | A | 3/1988 | Watts | 285/4 |
| 4,735,444 | A | 4/1988 | Skipper | |
| 4,739,916 | A | 4/1988 | Ayres et al. | |
| 4,776,394 | A | 10/1988 | Lynde et al. | |
| 4,793,382 | A | 12/1988 | Szalvay | 138/98 |
| 4,796,668 | A | 1/1989 | Depret | |
| 4,817,710 | A | 4/1989 | Edwards et al. | 166/242 |
| 4,817,716 | A | 4/1989 | Taylor et al. | 166/277 |
| 4,827,594 | A | 5/1989 | Cartry et al. | |
| 4,828,033 | A | 5/1989 | Frison | |
| 4,830,109 | A | 5/1989 | Wedel | 166/277 |
| 4,865,127 | A | 9/1989 | Koster | 166/277 |
| 4,872,253 | A | 10/1989 | Carstensen | |
| 4,887,646 | A | 12/1989 | Groves | |

4,892,337 A 1/1990 Gunderson et al.
4,893,658 A 1/1990 Kimura et al.
4,907,828 A 3/1990 Change
4,913,758 A 4/1990 Koster ..... 156/191
4,915,426 A 4/1990 Skipper
4,934,312 A 6/1990 Koster et al. ..... 118/410
4,941,512 A 7/1990 McParland ..... 138/97
4,941,532 A 7/1990 Hurt et al. ..... 166/216
4,942,926 A 7/1990 Lessi
4,958,691 A 9/1990 Hipp
4,968,184 A 11/1990 Reid ..... 405/225
4,971,152 A 11/1990 Koster et al. ..... 166/277
4,976,322 A 12/1990 Abdrakhmanov et al. .... 175/57
4,981,250 A 1/1991 Persson ..... 228/107
5,014,779 A 5/1991 Meling et al. ..... 166/55.7
5,015,017 A 5/1991 Geary
5,031,699 A 7/1991 Artynov et al. ..... 166/285
5,040,283 A 8/1991 Pelgrom ..... 29/447
5,044,676 A 9/1991 Burton et al.
5,052,483 A 10/1991 Hudson ..... 166/55
5,059,043 A 10/1991 Kuhne
5,079,837 A 1/1992 Vanselow
5,083,608 A 1/1992 Abdrakhmanov et al. .... 166/55
5,093,015 A 3/1992 Oldiges
5,095,991 A 3/1992 Milberger
5,107,221 A 4/1992 N'Guyen et al. ..... 328/233
5,119,661 A 6/1992 Abdrakhmanov et al. .... 72/276
5,156,043 A 10/1992 Ose ..... 73/49.8
5,156,223 A 10/1992 Hipp
5,174,376 A 12/1992 Singeetham ..... 166/208
5,181,571 A 1/1993 Mueller et al.
5,197,553 A 3/1993 Leturno ..... 175/57
5,209,600 A 5/1993 Koster ..... 403/344
5,226,492 A 7/1993 Solaeche et al. ..... 166/196
5,286,393 A 2/1994 Oldiges et al.
5,314,209 A 5/1994 Kuhne
5,318,122 A 6/1994 Murray et al. ..... 166/313
5,318,131 A 6/1994 Baker ..... 166/382
5,325,923 A 7/1994 Surjaatmadja et al. ..... 166/308
5,332,038 A 7/1994 Tapp et al. ..... 166/278
5,332,049 A 7/1994 Tew
5,333,692 A 8/1994 Baugh et al.
5,335,736 A 8/1994 Windsor ..... 175/57
5,337,808 A 8/1994 Graham ..... 166/191
5,337,823 A 8/1994 Nobileau
5,339,894 A 8/1994 Stotler
5,343,949 A 9/1994 Ross et al.
5,346,007 A 9/1994 Dillon et al. ..... 166/254
5,348,087 A 9/1994 Williamson, Jr. ..... 166/115
5,348,093 A 9/1994 Wood et al.
5,348,095 A 9/1994 Worrall et al. ..... 166/380
5,348,668 A 9/1994 Oldiges et al.
5,351,752 A 10/1994 Wood et al.
5,360,292 A 11/1994 Allen et al. ..... 405/249
5,361,843 A 11/1994 Shy et al. ..... 166/297
5,366,010 A 11/1994 Zwart ..... 166/120
5,366,012 A 11/1994 Lohbeck ..... 166/277
5,368,075 A 11/1994 Baro et al.
5,370,425 A 12/1994 Dougherty et al.
5,375,661 A 12/1994 Daneshy et al.
5,388,648 A 2/1995 Jordan, Jr. ..... 166/380
5,390,735 A 2/1995 Williamson, Jr. ..... 166/115
5,390,742 A 2/1995 Dines et al. ..... 166/297
5,396,957 A 3/1995 Surjaatmadja et al. ..... 166/308
5,405,171 A 4/1995 Allen et al.
5,425,559 A 6/1995 Nobileau ..... 285/330
5,426,130 A 6/1995 Thurber et al.
5,435,395 A 7/1995 Connell
5,439,320 A 8/1995 Abrams ..... 405/154
5,447,201 A 9/1995 Mohn
5,454,419 A 10/1995 Vloedman
5,467,822 A 11/1995 Zwart ..... 166/179
5,472,055 A 12/1995 Simson et al.
5,474,334 A 12/1995 Eppink
5,494,106 A 2/1996 Gueguen et al. ..... 166/277
5,507,343 A 4/1996 Carlton et al. ..... 166/277
5,511,620 A 4/1996 Baugh et al.
5,524,937 A 6/1996 Sides, III et al.
5,535,824 A 7/1996 Hudson ..... 166/207
5,536,422 A 7/1996 Oldiges et al.
5,576,485 A 11/1996 Serata
5,606,792 A 3/1997 Schafer ..... 29/727
5,611,399 A 3/1997 Richard et al.
5,613,557 A 3/1997 Blount et al. ..... 166/277
5,617,918 A 4/1997 Cooksey et al. ..... 166/115
5,642,560 A 7/1997 Tabuchi et al.
5,642,781 A 7/1997 Richard
5,664,327 A 9/1997 Swars ..... 29/888.08
5,667,011 A 9/1997 Gill et al. ..... 166/295
5,667,252 A 9/1997 Schafer et al. ..... 285/15
5,685,369 A 11/1997 Ellis et al. ..... 166/195
5,689,871 A 11/1997 Carstensen
5,695,008 A 12/1997 Bertet et al. ..... 166/187
5,695,009 A 12/1997 Hipp
5,718,288 A 2/1998 Bertet et al. ..... 166/287
5,775,422 A 7/1998 Wong et al.
5,785,120 A 7/1998 Smalley et al. ..... 166/55
5,787,933 A 8/1998 Russ et al.
5,791,419 A 8/1998 Valisalo ..... 175/53
5,794,702 A 8/1998 Nobileau ..... 166/380
5,797,454 A 8/1998 Hipp
5,829,520 A 11/1998 Johnson ..... 166/250.01
5,829,524 A 11/1998 Flanders et al. ..... 166/277
5,833,001 A 11/1998 Song et al.
5,845,945 A 12/1998 Carstensen
5,849,188 A 12/1998 Voll et al.
5,857,524 A 1/1999 Harris ..... 166/382
5,875,851 A 3/1999 Vick, Jr. et al. ..... 166/386
5,885,941 A 3/1999 Sateva et al.
5,901,789 A 5/1999 Donnelly et al. ..... 166/381
5,918,677 A 7/1999 Head
5,924,745 A 7/1999 Campbell ..... 285/90
5,931,511 A 8/1999 DeLange et al.
5,944,107 A 8/1999 Ohmer ..... 166/313
5,951,207 A 9/1999 Chen ..... 405/232
5,957,195 A 9/1999 Bailey et al. ..... 166/55
5,979,560 A 11/1999 Nobileau ..... 166/381
5,984,369 A 11/1999 Crook et al.
5,984,568 A 11/1999 Lohbeck ..... 403/375
6,012,522 A 1/2000 Donnelly et al. ..... 166/276
6,012,523 A 1/2000 Campbell et al. ..... 166/277
6,012,874 A 1/2000 Groneck et al. ..... 405/239
6,017,168 A 1/2000 Fraser, Jr. et al. ..... 405/224.4
6,021,850 A 2/2000 Wood et al. ..... 166/380
6,029,748 A 2/2000 Forsyth et al. ..... 166/380
6,035,954 A 3/2000 Hipp
6,044,906 A 4/2000 Saltel ..... 166/187
6,047,505 A 4/2000 Willow
6,047,774 A 4/2000 Allen
6,050,341 A 4/2000 Metcalf ..... 166/383
6,050,346 A 4/2000 Hipp
6,056,059 A 5/2000 Ohmer ..... 166/313
6,062,324 A 5/2000 Hipp
6,065,500 A 5/2000 Metcalfe ..... 138/118
6,070,671 A 6/2000 Cumming et al. ..... 166/381
6,074,133 A 6/2000 Kelsey ..... 405/244
6,078,031 A 6/2000 Bliault et al. ..... 219/607
6,079,495 A 6/2000 Ohmer ..... 166/313
6,085,838 A 7/2000 Vercaemer et al. ..... 166/277
6,089,320 A 7/2000 LaGrange ..... 166/313
6,098,717 A 8/2000 Bailey et al. ..... 166/382
6,102,119 A 8/2000 Raines ..... 166/244.1

| | | | | |
|---|---|---|---|---|
| 6,109,355 | A | 8/2000 | Reid | |
| 6,112,818 | A | 9/2000 | Campbell | 166/384 |
| 6,131,265 | A | 10/2000 | Bird | |
| 6,135,208 | A * | 10/2000 | Gano et al. | 166/313 |
| 6,142,230 | A | 11/2000 | Smalley et al. | |
| 6,182,775 | B1 | 2/2001 | Hipp | |
| 6,196,336 | B1 | 3/2001 | Fincher et al. | |
| 6,226,855 | B1 | 5/2001 | Maine | 29/507 |
| 6,250,385 | B1 | 6/2001 | Montaron | 166/207 |
| 6,263,968 | B1 | 7/2001 | Freeman et al. | |
| 6,263,972 | B1 | 7/2001 | Richard et al. | |
| 6,283,211 | B1 | 9/2001 | Vloedman | |
| 6,315,043 | B1 | 11/2001 | Farrant et al. | |
| 6,328,113 | B1 | 12/2001 | Cook | |
| 6,345,431 | B1 | 2/2002 | Greig | |
| 6,354,373 | B1 | 3/2002 | Vercaemer et al. | |
| 6,409,175 | B1 | 6/2002 | Evans et al. | |
| 6,419,033 | B1 | 7/2002 | Hahn et al. | |
| 6,419,147 | B1 | 7/2002 | Daniel | |
| 6,425,444 | B1 | 7/2002 | Metcalfe et al. | |
| 6,446,724 | B2 | 9/2002 | Baugh et al. | |
| 6,454,013 | B1 | 9/2002 | Metcalfe | |
| 6,457,532 | B1 | 10/2002 | Simpson | |
| 6,457,533 | B1 | 10/2002 | Metcalfe | |
| 6,457,749 | B1 | 10/2002 | Heijnen | |
| 6,460,615 | B1 | 10/2002 | Heijnen | |
| 6,470,966 | B2 | 10/2002 | Cook et al. | |
| 6,517,126 | B1 | 2/2003 | Peterson et al. | |
| 6,527,049 | B2 | 3/2003 | Metcalfe et al. | |
| 6,543,552 | B1 | 4/2003 | Metcalfe et al. | |
| 2001/0002626 | A1 | 6/2001 | Frank et al. | |
| 2002/0011339 | A1 | 1/2002 | Murray | |
| 2002/0014339 | A1 | 2/2002 | Ross | |
| 2002/0062956 | A1 | 5/2002 | Murray et al. | |
| 2002/0066576 | A1 | 6/2002 | Cook et al. | |
| 2002/0066578 | A1 | 6/2002 | Broome | |
| 2002/0070023 | A1 | 6/2002 | Turner et al. | |
| 2002/0070031 | A1 | 6/2002 | Voll et al. | |
| 2002/0079101 | A1 | 6/2002 | Baugh et al. | |
| 2002/0084070 | A1 | 7/2002 | Voll et al. | |
| 2002/0092654 | A1 | 7/2002 | Coronado et al. | |
| 2002/0139540 | A1 | 10/2002 | Lauritzen | |
| 2002/0144822 | A1 | 10/2002 | Hackworth et al. | |
| 2002/0148612 | A1 | 10/2002 | Cook et al. | |
| 2002/0185274 | A1 | 12/2002 | Simpson et al. | |
| 2002/0189816 | A1 | 12/2002 | Cook et al. | |
| 2002/0195252 | A1 | 12/2002 | Maguire et al. | |
| 2002/0195256 | A1 | 12/2002 | Metcalfe et al. | |
| 2003/0024711 | A1 | 2/2003 | Simpson et al. | |
| 2003/0056991 | A1 | 3/2003 | Hahn et al. | |

FOREIGN PATENT DOCUMENTS

| | | | | |
|---|---|---|---|---|
| CN | 94068 | | 4/2000 | |
| CN | 107870 | | 4/2000 | |
| DE | 174521 | | 4/1953 | |
| DE | 2458188 | | 6/1979 | |
| DE | 203767 | | 11/1983 | E21B/43/10 |
| DE | 233607 | | 3/1986 | E21B/17/00 |
| DE | 278517 | | 5/1990 | B21D/28/28 |
| DE | 10007547 | | 9/2000 | E02D/7/28 |
| EP | 0272511 | | 12/1987 | |
| EP | 0553566 | A1 | 12/1992 | |
| EP | 0633391 | A2 | 1/1995 | E21B/34/14 |
| EP | 0713953 | B1 | 11/1995 | |
| EP | 0823534 | | 2/1998 | E21B/7/06 |
| EP | 0881354 | | 12/1998 | E21B/43/10 |
| EP | 0881359 | | 12/1998 | E21D/9/08 |
| EP | 0899420 | | 3/1999 | E21B/43/10 |
| EP | 0937961 | | 8/1999 | E21B/43/10 |
| EP | 0952305 | | 10/1999 | E21B/43/10 |
| EP | 0952306 | | 10/1999 | E21B/43/10 |
| EP | 1152120 | A2 | 11/2001 | |
| FR | 2711133 | | 4/1995 | |
| FR | 2717855 | | 9/1995 | E21B/17/00 |
| FR | 2741907 | | 6/1997 | E21B/7/20 |
| FR | 2780751 | | 1/2000 | E21B/33/127 |
| GB | 557823 | | 12/1943 | |
| GB | 961750 | | 6/1964 | |
| GB | 1062610 | | 3/1967 | |
| GB | 1111536 | | 5/1968 | |
| GB | 1448304 | | 9/1976 | |
| GB | 1460864 | | 1/1977 | |
| GB | 1542847 | | 3/1979 | |
| GB | 1563740 | | 3/1980 | |
| GB | 2058877 | | 4/1981 | |
| GB | 2108228 | A | 5/1983 | |
| GB | 2115860 | | 9/1983 | |
| GB | 2211573 | A | 7/1989 | |
| GB | 2216926 | | 10/1989 | |
| GB | 2243191 | | 10/1991 | |
| GB | 2256910 | | 12/1992 | F16L/9/18 |
| GB | 2305682 | | 4/1997 | |
| GB | 2325949 | A | 5/1998 | |
| GB | 2322655 | | 9/1998 | E21B/23/04 |
| GB | 2326896 | | 1/1999 | E21B/17/00 |
| GB | 2329916 | | 4/1999 | E21B/17/00 |
| GB | 2329918 | | 4/1999 | E21B/29/00 |
| GB | 2336383 | | 10/1999 | E21B/43/08 |
| GB | 2355738 | A | 4/2000 | |
| GB | 2343691 | | 5/2000 | E21B/43/14 |
| GB | 2344606 | | 6/2000 | E21B/33/14 |
| GB | 2368865 | A | 7/2000 | |
| GB | 2346165 | | 8/2000 | E21B/43/10 |
| GB | 2346632 | | 8/2000 | E21B/43/10 |
| GB | 2347445 | | 9/2000 | E21B/7/20 |
| GB | 2347446 | A | 9/2000 | E21B/43/10 |
| GB | 2347950 | A | 9/2000 | E21B/33/047 |
| GB | 2347952 | A | 9/2000 | E21B/43/10 |
| GB | 2348223 | A | 9/2000 | E21B/7/20 |
| GB | 2348657 | A | 10/2000 | E21B/43/10 |
| GB | 2357099 | A | 12/2000 | |
| GB | 2350137 | B | 8/2001 | |
| GB | 2359837 | B | 4/2002 | |
| GB | 2370301 | | 6/2002 | |
| GB | 2371064 | | 7/2002 | |
| GB | 2371574 | A | 7/2002 | |
| GB | 2367842 | A | 10/2002 | |
| GB | 2375560 | A | 11/2002 | |
| JP | 208458 | | 10/1985 | C22C/38/52 |
| JP | 64-75715 | | 3/1989 | |
| JP | 102875 | | 4/1995 | E21D/5/10 |
| JP | 94068 | | 4/2000 | B21D/39/20 |
| JP | 107870 | | 4/2000 | B23K/20/00 |
| JP | 162192 | | 6/2000 | G01N/29/14 |
| NL | 9001081 | | 12/1991 | E21B/33/12 |
| RO | 113267 | | 5/1998 | E21B/10/32 |
| RU | 2039214 | | 7/1995 | E21B/43/00 |
| RU | 2056201 | | 3/1996 | B21D/39/10 |
| RU | 2064357 | | 7/1996 | B21D/39/10 |
| RU | 2068940 | | 11/1996 | E21B/29/10 |
| RU | 2068943 | | 11/1996 | E21B/33/13 |
| RU | 2079633 | | 5/1997 | E21B/7/06 |
| RU | 2083798 | | 7/1997 | E21B/33/12 |
| RU | 2091655 | | 9/1997 | F16L/9/02 |
| RU | 2095179 | | 11/1997 | B21D/39/04 |
| RU | 2105128 | | 2/1998 | E21B/29/00 |
| RU | 2108445 | | 4/1998 | E21B/33/13 |
| RU | 2144128 | | 1/2000 | E21B/29/10 |
| SU | 350833 | | 9/1972 | C21C/5/52 |
| SU | 511468 | | 9/1976 | |
| SU | 607950 | | 5/1978 | E21B/29/00 |
| SU | 612004 | | 5/1978 | E21B/29/00 |

| | | | | |
|---|---|---|---|---|
| SU | 620582 | | 7/1978 | E21B/29/00 |
| SU | 641070 | | 1/1979 | |
| SU | 832049 | | 5/1981 | |
| SU | 853089 | | 8/1981 | |
| SU | 874952 | | 10/1981 | E21B/17/28 |
| SU | 894169 | | 1/1982 | E21B/7/28 |
| SU | 899850 | | 1/1982 | E21B/33/00 |
| SU | 907220 | | 2/1982 | E21B/33/12 |
| SU | 909114 | | 2/1982 | |
| SU | 953172 | | 8/1982 | E21B/7/20 |
| SU | 959878 | | 9/1982 | B21D/41/02 |
| SU | 976019 | | 11/1982 | E21B/29/10 |
| SU | 976020 | | 11/1982 | E21B/29/10 |
| SU | 989038 | | 1/1983 | E21B/29/10 |
| SU | 1002514 | | 3/1983 | E21B/29/10 |
| SU | 1041671 | | 9/1983 | E21B/29/10 |
| SU | 1051222 | | 10/1983 | E21B/29/10 |
| SU | 1086118 | | 4/1984 | E21B/29/00 |
| SU | 1158400 | | 5/1985 | B60M/3/00 |
| SU | 1212575 | | 2/1986 | E21B/7/28 |
| SU | 1250637 | | 8/1986 | E21B/7/20 |
| SU | 1324722 | A1 | 7/1987 | |
| SU | 1411434 | | 7/1988 | E21B/29/10 |
| SU | 1430498 | | 10/1988 | E21B/29/10 |
| SU | 1432190 | | 10/1988 | E21B/29/10 |
| SU | 1601330 | | 10/1990 | E21B/29/10 |
| SU | 1627663 | | 2/1991 | E21B/29/10 |
| SU | 1659621 | | 6/1991 | |
| SU | 1663179 | | 7/1991 | E21B/29/10 |
| SU | 1663180 | | 7/1991 | E21B/29/10 |
| SU | 1677225 | | 9/1991 | E21B/7/28 |
| SU | 1677248 | | 9/1991 | E21B/29/10 |
| SU | 1686123 | | 10/1991 | E21B/29/10 |
| SU | 1686124 | | 10/1991 | E21B/29/10 |
| SU | 1686125 | | 10/1991 | E21B/29/10 |
| SU | 1698413 | | 12/1991 | E21B/7/28 |
| SU | 1710694 | | 2/1992 | E21B/29/10 |
| SU | 1730429 | | 4/1992 | E21B/33/13 |
| SU | 1745873 | | 7/1992 | E21B/29/10 |
| SU | 1747673 | | 7/1992 | E21B/29/10 |
| SU | 1749267 | | 7/1992 | C21D/9/08 |
| SU | 1786241 | | 1/1993 | E21B/33/10 |
| SU | 1804543 | | 3/1993 | E21B/29/10 |
| SU | 1810482 | | 4/1993 | E21B/29/10 |
| SU | 1818459 | | 5/1993 | E21B/29/10 |
| SU | 2016345 | | 7/1994 | F16L/58/00 |
| SU | 1295799 | | 2/1995 | E21B/29/10 |
| WO | 8100132 | | 1/1981 | E21B/43/10 |
| WO | 9005598 | | 3/1990 | B21C/3/08 |
| WO | 9201859 | | 2/1992 | E21D/20/00 |
| WO | 9208875 | | 5/1992 | E21B/43/14 |
| WO | 9325799 | | 12/1993 | E21B/43/10 |
| WO | 9325800 | | 12/1993 | E21B/43/10 |
| WO | 9421887 | | 9/1994 | E21B/33/14 |
| WO | 9425655 | | 11/1994 | D04C/1/06 |
| WO | 9503476 | | 2/1995 | E21B/43/10 |
| WO | 9601937 | | 1/1996 | E21B/33/127 |
| WO | 9621083 | | 7/1996 | E21B/43/10 |
| WO | 9626350 | | 8/1996 | E21B/43/11 |
| WO | 9637681 | | 11/1996 | E21B/17/08 |
| WO | 9706346 | | 2/1997 | E21B/43/10 |
| WO | 9711306 | | 3/1997 | F16L/55/165 |
| WO | 9717524 | | 5/1997 | E21B/43/08 |
| WO | 9717526 | | 5/1997 | E21B/43/10 |
| WO | 9717527 | | 5/1997 | E21B/43/10 |
| WO | 9720130 | | 6/1997 | E21B/43/10 |
| WO | 9721901 | | 6/1997 | E21B/17/08 |
| WO | 9800626 | | 1/1998 | E21B/43/10 |
| WO | 9807957 | | 2/1998 | E21B/43/10 |
| WO | 9809053 | | 3/1998 | E21B/33/14 |
| WO | 9822690 | | 5/1998 | E21B/17/08 |
| WO | 9826152 | | 6/1998 | E21B/17/08 |
| WO | 9842947 | | 10/1998 | E21B/17/08 |
| WO | 9849423 | | 11/1998 | E21B/43/10 |
| WO | 9902818 | | 1/1999 | E21B/43/10 |
| WO | 9904135 | | 1/1999 | E21B/23/00 |
| WO | 9906670 | | 2/1999 | E21B/43/10 |
| WO | 9908827 | | 2/1999 | B23K/13/02 |
| WO | 9908828 | | 2/1999 | B23K/20/02 |
| WO | 9918328 | | 4/1999 | E21B/23/01 |
| WO | 9923354 | | 5/1999 | E21B/43/10 |
| WO | 9925524 | | 5/1999 | B26F/1/00 |
| WO | 9925951 | | 5/1999 | E21B/43/10 |
| WO | 9935368 | | 7/1999 | E21B/43/10 |
| WO | 9943923 | | 9/1999 | E21B/33/13 |
| WO | 0001926 | | 1/2000 | E21B/43/26 |
| WO | 0004271 | | 1/2000 | E21B/17/07 |
| WO | 0008301 | | 2/2000 | E21B/43/08 |
| WO | 0026500 | | 5/2000 | E21B/19/22 |
| WO | 0026501 | | 5/2000 | E21B/23/01 |
| WO | 0026502 | | 5/2000 | E21B/29/10 |
| WO | 0031375 | | 6/2000 | E21B/43/10 |
| WO | 0037767 | | 6/2000 | E21B/29/00 |
| WO | 0037768 | | 6/2000 | E21B/29/10 |
| WO | 0037771 | | 6/2000 | E21B/43/10 |
| WO | 0037772 | | 6/2000 | E21B/43/10 |
| WO | 0039432 | | 7/2000 | E21B/43/10 |
| WO | 0046484 | | 8/2000 | E21B/43/10 |
| WO | 0050727 | | 8/2000 | E21B/7/08 |
| WO | 0050732 | | 8/2000 | E21B/43/10 |
| WO | 0050733 | | 8/2000 | E21B/43/10 |
| WO | 0077431 | A2 | 12/2000 | |
| WO | WO01/04535 | A1 | 1/2001 | |
| WO | WO01/83943 | | 11/2001 | |
| WO | WO02/25059 | | 3/2002 | |
| WO | WO02/095181 | A1 | 5/2002 | |
| WO | WO02/075107 | A1 | 9/2002 | |
| WO | WO02/077411 | A1 | 10/2002 | |
| WO | WO02/081863 | A1 | 10/2002 | |
| WO | WO02/081864 | A2 | 10/2002 | |
| WO | WO02/086285 | A1 | 10/2002 | |
| WO | WO02/086286 | A2 | 10/2002 | |
| WO | WO02/090713 | | 11/2002 | |
| WO | WO02/103150 | A2 | 12/2002 | |
| WO | WO03/012255 | A1 | 2/2003 | |
| WO | WO03/023178 | A2 | 3/2003 | |
| WO | WO03/023179 | A2 | 3/2003 | |

OTHER PUBLICATIONS

Search Report to Application No. GB 9926450.9, Claims Searched 1–8, Feb. 28, 2000.

Search Report to Application No. GB 9930398.4, Claims Searched 1–35, Jun. 27, 2000.

Search Report to Application No. GB 0003251.6, Claims Searched 1–5, Jul. 13, 2000.

International Search Report, Application No. PCT/US00/30022, Oct. 31, 2000.

Search Report to Application No. GB 0004285.3, Claims Searched 2–3, 8–9, 13–16, Jan. 17, 2001.

Search Report to Application No. GB 0005399.1, Claims Searched 25–29, Feb. 15, 2001.

International Search Report, Application No. PCT/US01/19014, Jun. 12, 2001.

Examination Report to Application No. GB 9926450.9, May 15, 2002.

Search Report to Application No. 1999 5593, Claims 1–8, Aug. 20, 2002.

Examination Report to Application No. GB 9926450.9, Nov. 22, 2002.

Search Report to Application No. GB 0219757.2, Claims Searched 1–7, Nov. 25, 2002.
Search Report to Application No. GB 0220872.6, Claims Searched 1–4, Dec. 5, 2002.
Search Report to Application No. GB 0219757.2, Claims Searched 9–13, Jan. 20, 2003.
Search Report to Application No. GB 0225505.7, Claim Searched 1, Mar. 5, 2003.
Search Report to Application No. GB 0220872.6, Claim Searched 6, 7–8, 9–12, 13, 14, 15–16, 17–19, 20, 21–22, 23, 24–25, 26–37, 38–51, 52–61, Mar. 13, 2003.
Examination Report to Application No. GB 0208367.3, Apr. 4, 2003.
Search Report to Application No. GB 0004285.3, Claims Searched 2–3, 8–9, 13–16, Jan. 17, 2001.
Search Report to Application No. GB 0005399.1, Claims Searched 25–29, Feb. 15, 2001.
Search Report to Application No. GB 9930398.4, Claims Searched 1–35, Jun. 27, 2000.
Search Report to Application No. GB 9926449.1, Claims Searched 6, 7, 8, 74–81, and 82–88, Jul. 4, 2001.
International Search Report, Application No. PCT/US01/04753, Jun. 17, 2001.

* cited by examiner

ISOLATION OF SUBTERRANEAN ZONES

CROSS REFERENCE TO RELATED APPLICATIONS

This application is a continuation-in-part of U.S. patent application Ser. No. 09/440,338, filed on Nov. 15, 1999, now U.S. Pat. No. 6,328,113, which claimed the benefit of the filing date of U.S. provisional patent application Ser. No. 60/108,558, filed on Nov. 16, 1998, the disclosures of which are incorporated herein by reference.

This application is related to the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial No. PCT/US00/18635, filed on Jul. 9, 2000, (11) U.S. provisional patent application serial No. 60/162,671, filed on Nov. 1, 1999, (12) U.S. provisional patent application serial No. 60/154,047, filed on Sep. 16, 1999, (13) U.S. provisional patent application serial No. 60/159,082, filed on Oct. 12, 1999, (14) U.S. provisional patent application serial No. 60/159,039, filed on Oct. 12, 1999, (15) U.S. provisional patent application serial No. 60/159,033, filed on Oct. 12, 1999, (16) U.S. provisional patent application serial No. 60/212,359, filed on Jun. 19, 2000, (17) U.S. provisional patent application serial No. 60/165,228, filed on Nov. 12, 1999, (18) U.S. provisional patent application serial no. 60/221,443, filed on Jul. 28, 2000, (19) U.S. provisional patent application serial No. 60/221,645, filed on Jul. 28, 2000, (20) U.S. provisional patent application serial No. 60/233,638, filed on Sep. 18, 2000, (21) U.S. provisional patent application serial No. 60/237,334, filed on Oct. 2, 2000, (22) U.S. provisional patent application serial No. 60/270,007, filed on Feb. 20, 2001; (23) U.S. provisional patent application serial No. 60/262,434, filed on Jan. 17, 2001; (24) U.S, provisional patent application serial No. 60/259,486, filed on Jan. 3, 2001; (25) U.S. provisional patent application serial No. 60/303,740, filed on Jul. 6, 2001; (26) U.S. provisional patent application serial No. 60/313,453, filed on Aug. 20, 2001; (27) U.S. provisional patent application serial No. 60/317,985, filed on Sep. 6, 2001; (28) U.S. provisional patent application serial No. 60/318,386, filed on Sep. 10, 2001; (29) U.S. provisional patent application serial No. 25791.60 filed on Oct. 3, 2001; and (30) U.S. utility patent application serial No. 60/233,638, filed on Oct. 3, 2001, the disclosures of which are incorporated herein by reference.

BACKGROUND OF THE INVENTION

This invention relates generally to oil and gas exploration, and in particular to isolating certain subterranean zones to facilitate oil and gas exploration.

During oil exploration, a wellbore typically traverses a number of zones within a subterranean formation. Some of these subterranean zones will produce oil and gas, while others will not. Further, it is often necessary to isolate subterranean zones from one another in order to facilitate the exploration for and production of oil and gas. Existing methods for isolating subterranean production zones in order to facilitate the exploration for and production of oil and gas are complex and expensive.

The present invention is directed to overcoming one or more of the limitations of the existing processes for isolating subterranean zones during oil and gas exploration.

SUMMARY OF THE INVENTION

According to one aspect of the present invention, an apparatus is provided that includes one or more solid tubular members, each solid tubular member including one or more external seals, one or more slotted tubular members coupled to the solid tubular members, a shoe coupled to one of the slotted tubular members, and one or more packers positioned within one or more of the tubular members. Each packer includes a radially expanded tubular member and one or more sealing members coupled to the outer surface of the radially expanded tubular member.

According to another aspect of the present invention, an apparatus is provided that includes one or more primary solid tubulars, each primary solid tubular including one or more external annular seals, n slotted tubulars coupled to the primary solid tubulars, n-1 intermediate solid tubulars coupled to and interleaved among the slotted tubulars, each intermediate solid tubular including one or more external annular seals, a shoe coupled to one of the slotted tubulars, and one or more packers positioned within one or more of the tubulars. Each packer includes a radially expanded tubular member and one or more sealing members coupled to the outer surface of the radially expanded tubular member.

According to another aspect of the present invention, a method of isolating a first subterranean zone from a second subterranean zone in a wellbore is provided that includes positioning one or more primary solid tubulars within the wellbore, the primary solid tubulars traversing the first subterranean zone, positioning one or more slotted tubulars within the wellbore, the slotted tubulars traversing the second subterranean zone, fluidicly coupling the slotted tubulars and the solid tubulars, preventing the passage of fluids from the first subterranean zone to the second subterranean zone within the wellbore external to the solid and slotted tubulars and fluidicly isolating one or more annular regions within one or more of the tubulars by the process of: positioning an expandable tubular member having one or more sealing members within the tubular, and radially expanding the expandable tubular member.

According to another aspect of the present invention, a method of extracting materials from a producing subterranean zone in a wellbore, at least a portion of the wellbore including a casing, is provided that includes positioning one or more primary solid tubulars within the wellbore, fluidicly coupling the primary solid tubulars with the casing, positioning one or more slotted tubulars within the wellbore, the slotted tubulars traversing the producing subterranean zone, fluidicly coupling the slotted tubulars with the solid tubulars, fluidicly isolating the producing subterranean zone from at least one other subterranean zone within the wellbore, fluidicly coupling at least one of the slotted tubulars with the producing subterranean zone, and fluidicly isolating one or more annular regions within one or more of the tubulars by the process of: positioning an expandable tubular member having one or more sealing members within the tubular, and radially expanding the expandable tubular member.

According to another aspect of the present invention, an apparatus for fluidicly isolating annular sections within a wellbore casing is provided that includes an expandable tubular member adapted to be positioned within the wellbore casing, one or more sealing members coupled to an outside surface of the expandable tubular member, and an expansion cone movably coupled to the expandable tubular member adapted to radially expand the expandable tubular member.

According to another aspect of the present invention, a method of fluidicly isolating annular sections within a wellbore casing is provided that includes positioning an expandable tubular member having one or more outer sealing members and an expansion cone within the wellbore casing, and axially displacing the expansion cone relative to the expandable tubular member.

According to another aspect of the present invention, a method of fluidicly isolating an annular section of a wellbore casing including a collapsed section is provided that includes positioning an expandable tubular member having one or more outer sealing members and an expansion cone within the wellbore casing, moving at least a portion of the expandable tubular member through the collapsed section of the wellbore casing, and axially displacing the expansion cone relative to the expandable tubular member.

According to another aspect of the present invention, a packer for sealing an annular region between the packer and a wellbore casing is provided that includes a radially expanded tubular member, and one or more sealing members coupled to the outer surface of the radially expanded tubular member for sealing the annular region between the radially expanded tubular member and the wellbore casing.

According to another aspect of the present invention, a method of operating a packer including an expandable tubular member and an annular sealing member coupled to the exterior of the expandable tubular member has been provided that includes positioning the packer within a subterranean borehole, and radially expanding the expandable tubular member using an expansion cone.

DETAILED DESCRIPTION OF THE ILLUSTRATIVE EMBODIMENTS

An apparatus and method for isolating one or more subterranean zones from one or more other subterranean zones is provided. The apparatus and method permits a producing zone to be isolated from a nonproducing zone using a combination of solid and slotted tubulars. In the production mode, the teachings of the present disclosure may be used in combination with conventional, well known, production completion equipment and methods using a series of packers, solid tubing, perforated tubing, and sliding sleeves, which will be inserted into the disclosed apparatus to permit the commingling and/or isolation of the subterranean zones from each other.

An apparatus and method for providing a packer for use in isolating one or more subterranean zones from one or more subterranean zones is also provided. The apparatus and method permit a packer to be provided by radially expanding a tubular member including one or more outer sealing members into engagement with a preexisting tubular structure.

Figure 1:
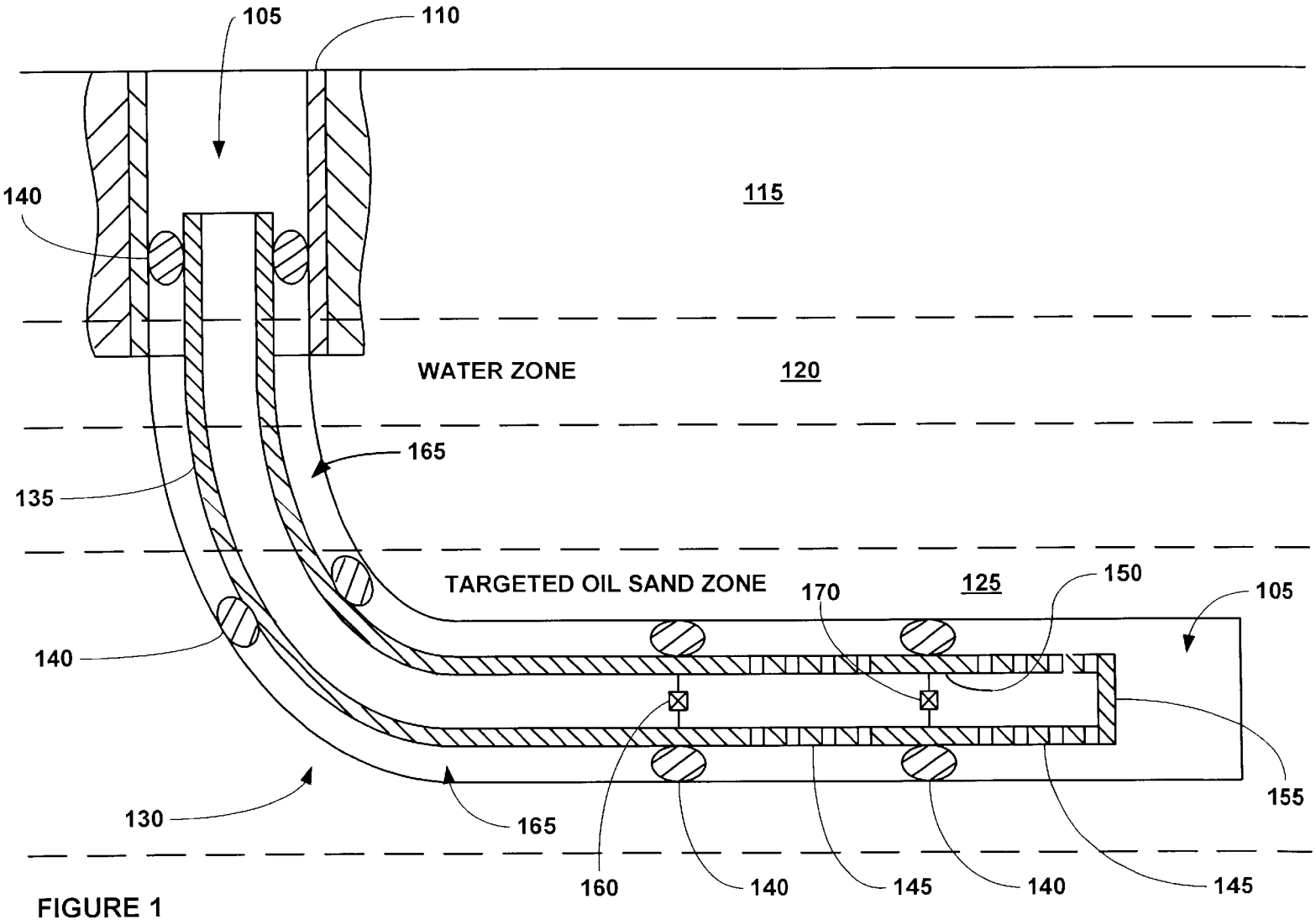
FIG. 1 is a fragmentary cross-sectional view illustrating the isolation of subterranean zones.

Referring to FIG. 1, a wellbore 105 including a casing 110 is positioned in a subterranean formation 115. The subterranean formation 115 includes a number of productive and non-productive zones, including a water zone 120 and a targeted oil sand zone 125. During exploration of the subterranean formation 115, the wellbore 105 may be extended in a well known manner to traverse the various productive and non-productive zones, including the water zone 120 and the targeted oil sand zone 125.

In a preferred embodiment, in order to fluidicly isolate the water zone 120 from the targeted oil sand zone 125, an apparatus 130 is provided that includes one or more sections of solid casing 135, one or more external seals 140, one or more sections of slotted casing 145, one or more intermediate sections of solid casing 150, and a solid shoe 155.

The solid casing 135 may provide a fluid conduit that transmits fluids and other materials from one end of the solid casing 135 to the other end of the solid casing 135. The solid casing 135 may comprise any number of conventional commercially available sections of solid tubular casing such as, for example, oilfield tubulars fabricated from chromium steel or fiberglass. In a preferred embodiment, the solid casing 135 comprises oilfield tubulars available from various foreign and domestic steel mills.

The solid casing 135 is preferably coupled to the casing 110. The solid casing 135 may be coupled to the casing 110 using any number of conventional commercially available processes such as, for example, welding, slotted and expandable connectors, or expandable solid connectors. In a preferred embodiment, the solid casing 135 is coupled to the casing 110 by using expandable solid connectors. The solid casing 135 may comprise a plurality of such solid casing 135.

The solid casing 135 is preferably coupled to one more of the slotted casings 145. The solid casing 135 may be coupled to the slotted casing 145 using any number of conventional commercially available processes such as, for example, welding, or slotted and expandable connectors. In a preferred embodiment, the solid casing 135 is coupled to the slotted casing 145 by expandable solid connectors.

In a preferred embodiment, the casing 135 includes one more valve members 160 for controlling the flow of fluids and other materials within the interior region of the casing 135. In an alternative embodiment, during the production mode of operation, an internal tubular string with various arrangements of packers, perforated tubing, sliding sleeves, and valves may be employed within the apparatus to provide various options for commingling and isolating subterranean zones from each other while providing a fluid path to the surface.

In a particularly preferred embodiment, the casing 135 is placed into the wellbore 105 by expanding the casing 135 in the radial direction into intimate contact with the interior walls of the wellbore 105. The casing 135 may be expanded in the radial direction using any number of conventional commercially available methods. In a preferred embodiment, the casing 135 is expanded in the radial direction using one or more of the apparatus and methods disclosed in the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb.

10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, attorney docket no. 25791.25.02, filed on Jul. 9, 2000, (11) U.S. provisional patent application serial No. 60/162,671, filed on Nov. 1, 1999, (12) U.S. provisional patent application serial No. 60/154,047, 75695.1 filed on Sep. 16, 1999, (13) U.S. provisional patent application serial No. 60/159,082, filed on Oct. 12, 1999, (14) U.S. provisional patent application serial No. 60/159,039, filed on Oct. 12, 1999, (15) U.S. provisional patent application serial No. 60/159,033, filed on Oct. 12, 1999, (16) U.S. provisional patent application serial No. 60/212,359, filed on Jun. 19, 2000, (17) U.S. provisional patent application serial No. 60/165,228, filed on Nov. 12, 1999, (18) U.S. provisional patent application serial No. 60/221,443, filed on Jul. 28, 2000, (19) U.S. provisional patent application serial No. 60/221,645, filed on Jul. 28, 2000, (20) U.S. provisional patent application serial No. 60/233,638, filed on Sep. 18, 2000, (21) U.S. provisional patent application serial No. 60/237,334, filed on Oct. 2, 2000, (22) U.S. provisional patent application serial No. 60/270,007, filed on Feb. 20, 2001; (23) U.S. provisional patent application serial No. 60/262,434, filed on Jan. 17, 2001; (24) U.S. provisional patent application serial No. 60/259,486, filed on Jan. 3, 2001; (25) U.S. provisional patent application serial No. 60/303,740, filed on Jul. 6, 2001; (26) U.S. provisional patent application serial No. 60/313,453 filed on Aug. 20, 2001; (27) U.S. provisional patent application serial No. 60/317,985, filed on Sep. 6, 2001; and (28) U.S. provisional patent application serial No. 60/318,386, filed on Sep. 10, 2001, the disclosures of which are incorporated herein by reference.

The seals 140 prevent the passage of fluids and other materials within the annular region 165 between the solid casings 135 and 150 and the wellbore 105. The seals 140 may comprise any number of conventional commercially available sealing materials suitable for sealing a casing in a wellbore such as, for example, lead, rubber or epoxy. In a preferred embodiment, the seals 140 comprise Stratalok epoxy material available from Halliburton Energy Services.

The slotted casing 145 permits fluids and other materials to pass into and out of the interior of the slotted casing 145 from and to the annular region 165. In this manner, oil and gas may be produced from a producing subterranean zone within a subterranean formation. The slotted casing 145 may comprise any number of conventional commercially available sections of slotted tubular casing. In a preferred embodiment, the slotted casing 145 comprises expandable slotted tubular casing available from Petroline in Abeerdeen, Scotland. In a particularly preferred embodiment, the slotted casing 145 comprises expandable slotted sandscreen tubular casing available from Petroline in Abeerdeen, Scotland.

The slotted casing 145 is preferably coupled to one or more solid casing 135. The slotted casing 145 may be coupled to the solid casing 135 using any number of conventional commercially available processes such as, for example, welding, or slotted or solid expandable connectors. In a preferred embodiment, the slotted casing 145 is coupled to the solid casing 135 by expandable solid connectors.

The slotted casing 145 is preferably coupled to one or more intermediate solid casings 150. The slotted casing 145 may be coupled to the intermediate solid casing 150 using any number of conventional commercially available processes such as, for example, welding or expandable solid or slotted connectors. In a preferred embodiment, the slotted casing 145 is coupled to the intermediate solid casing 150 by expandable solid connectors.

The last slotted casing 145 is preferably coupled to the shoe 155. The last slotted casing 145 may be coupled to the shoe 155 using any number of conventional commercially available processes such as, for example, welding or expandable solid or slotted connectors. In a preferred embodiment, the last slotted casing 145 is coupled to the shoe 155 by an expandable solid connector.

In an alternative embodiment, the shoe 155 is coupled directly to the last one of the intermediate solid casings 150.

In a preferred embodiment, the slotted casings 145 are positioned within the wellbore 105 by expanding the slotted casings 145 in a radial direction into intimate contact with the interior walls of the wellbore 105. The slotted casings 145 may be expanded in a radial direction using any number of conventional commercially available processes.

The intermediate solid casing 150 permits fluids and other materials to pass between adjacent slotted casings 145. The intermediate solid casing 150 may comprise any number of conventional commercially available sections of solid tubular casing such as, for example, oilfield tubulars fabricated from chromium steel or fiberglass. In a preferred embodiment, the intermediate solid casing 150 comprises oilfield tubulars available from foreign and domestic steel mills.

The intermediate solid casing 150 is preferably coupled to one or more sections of the slotted casing 145. The intermediate solid casing 150 may be coupled to the slotted casing 145 using any number of conventional commercially available processes such as, for example, welding, or solid or slotted expandable connectors. In a preferred embodiment, the intermediate solid casing 150 is coupled to the slotted casing 145 by expandable solid connectors. The intermediate solid casing 150 may comprise a plurality of such intermediate solid casing 150.

In a preferred embodiment, each intermediate solid casing 150 includes one more valve members 170 for controlling the flow of fluids and other materials within the interior region of the intermediate casing 150. In an alternative embodiment, as will be recognized by persons having ordinary skill in the art and the benefit of the present disclosure, during the production mode of operation, an internal tubular string with various arrangements of packers, perforated tubing, sliding sleeves, and valves may be employed within the apparatus to provide various options for commingling and isolating subterranean zones from each other while providing a fluid path to the surface.

In a particularly preferred embodiment, the intermediate casing 150 is placed into the wellbore 105 by expanding the intermediate casing 150 in the radial direction into intimate contact with the interior walls of the wellbore 105. The intermediate casing 150 may be expanded in the radial direction using any number of conventional commercially available methods.

In an alternative embodiment, one or more of the intermediate solid casings 150 may be omitted. In an alternative preferred embodiment, one or more of the slotted casings 145 are provided with one or more seals 140.

The shoe 155 provides a support member for the apparatus 130. In this manner, various production and exploration tools may be supported by the show 150. The shoe 150 may comprise any number of conventional commercially available shoes suitable for use in a wellbore such as, for example, cement filled shoe, or an aluminum or composite shoe. In a preferred embodiment, the shoe 150 comprises an aluminum shoe available from Halliburton. In a preferred embodiment, the shoe 155 is selected to provide sufficient strength in compression and tension to permit the use of high capacity production and exploration tools.

In a particularly preferred embodiment, the apparatus 130 includes a plurality of solid casings 135, a plurality of seals 140, a plurality of slotted casings 145, a plurality of intermediate solid casings 150, and a shoe 155. More generally, the apparatus 130 may comprise one or more solid casings 135, each with one or more valve members 160, n slotted casings 145, n-1 intermediate solid casings 150, each with one or more valve members 170, and a shoe 155.

During operation of the apparatus 130, oil and gas may be controllably produced from the targeted oil sand zone 125 using the slotted casings 145. The oil and gas may then be transported to a surface location using the solid casing 135. The use of intermediate solid casings 150 with valve members 170 permits isolated sections of the zone 125 to be selectively isolated for production. The seals 140 permit the zone 125 to be fluidicly isolated from the zone 120. The seals 140 further permits isolated sections of the zone 125 to be fluidicly isolated from each other. In this manner, the apparatus 130 permits unwanted and/or non-productive subterranean zones to be fluidicly isolated.

In an alternative embodiment, as will be recognized by persons having ordinary skill in the art and also having the benefit of the present disclosure, during the production mode of operation, an internal tubular string with various arrangements of packers, perforated tubing, sliding sleeves, and valves may be employed within the apparatus to provide various options for commingling and isolating subterranean zones from each other while providing a fluid path to the surface.

Figure 2A:
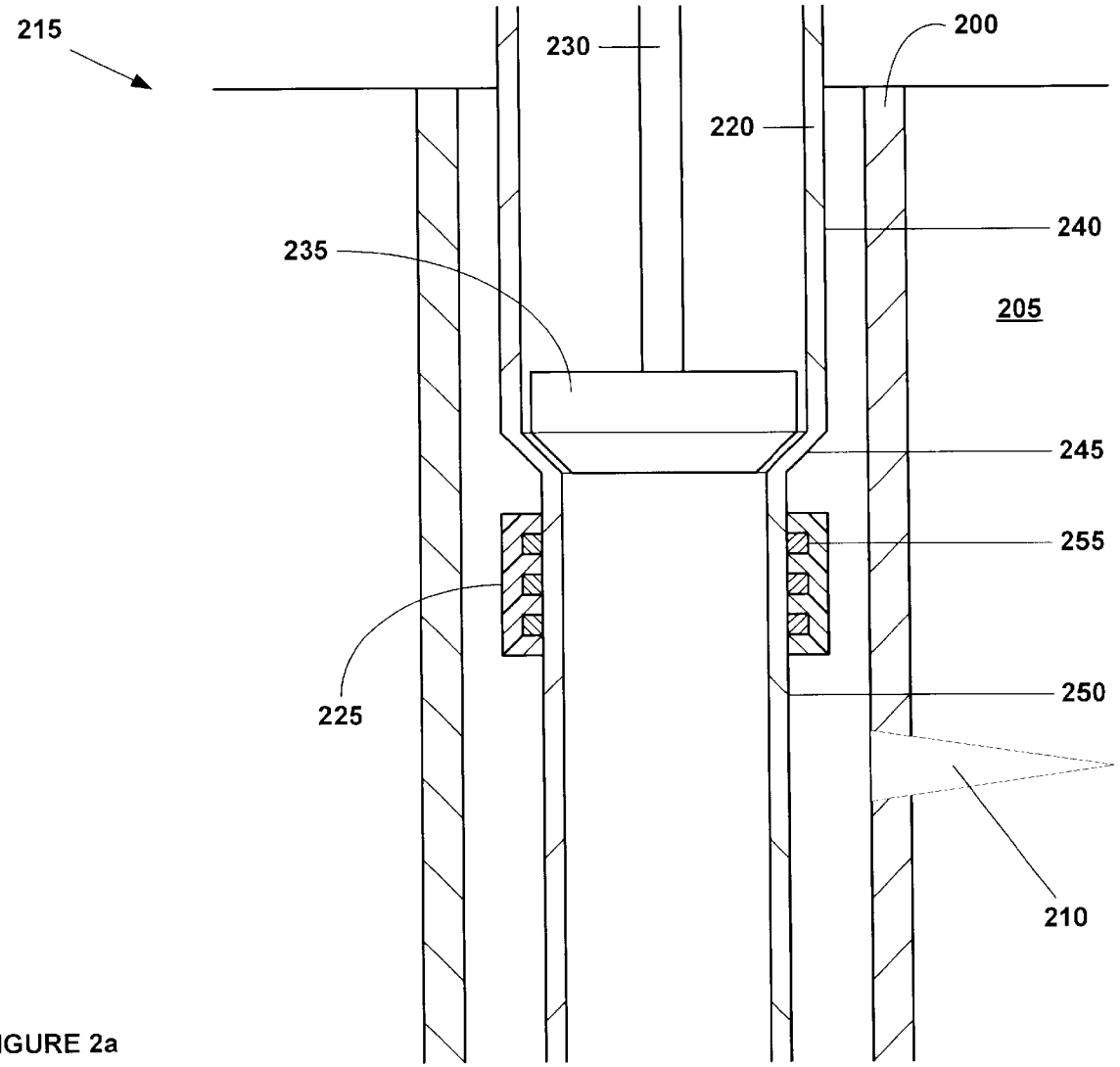
FIG. 2*a* is a fragmentary cross-sectional illustration of an embodiment of an apparatus for fluidicly isolating annular regions within a wellbore casing.

Referring to FIGS., 2*a*, 2*b*, and 2*c*, a preferred embodiment of a method and apparatus for fluidicly isolating a section of a wellbore casing will be described. Referring to FIG. 2*a*, a wellbore casing 200 is positioned within a subterranean formation 205. The wellbore casing 200 may be positioned in any orientation from the vertical direction to the horizontal direction. The wellbore casing 200 further includes one or more openings 210 that may have been, for example, the result of: (1) unintentional damage to the wellbore casing 200, (2) a prior perforation or fracturing operation performed upon the surrounding subterranean formation 205, or (3) a slotted section of the wellbore casing 200. As will be recognized by persons having ordinary skill in the art, the openings 210 can affect the subsequent operation and use of the wellbore casing 200 unless they are fluidicly isolated from other regions within the wellbore casing 200. In a preferred embodiment, an apparatus 215 is utilized to fluidicly isolate openings 110 within the wellbore casing 100.

The apparatus 215 preferably includes an expandable tubular member 220, one or more sealing members 225, a support member 230, and an expansion cone 235.

The expandable tubular member 220 is preferably adapted to be supported from above by conventional support members. The expandable tubular member 220 is further coupled to the sealing members 225 and movably coupled to the expansion cone 235. The expandable tubular member 220 preferably includes an upper section 240, an intermediate section 245, and a lower section 250. In a preferred embodiment, the upper and intermediate sections, 240 and 245, are adapted to mate with the expansion cone 235. In a preferred embodiment, the wall thickness of the lower section 250 is less than the wall thickness of the upper and intermediate sections, 240 and 245.

In a preferred embodiment, the expandable tubular member 220 is provided as disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, attorney docket no. 25791.8.02, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application serial No. 60/162,671, filed on Nov. 1, 1999, (12) U.S. provisional patent application serial No. 60/154,047, filed on Sep. 16, 1999, (13) U.S. provisional patent application serial No. 60/159,082, filed on Oct. 12, 1999, (14) U.S. provisional patent application serial No. 60/159,039, filed on Oct. 12, 1999, (15) U.S. provisional patent application serial No. 60/159,033, filed on Oct. 12, 1999, (16) U.S. provisional patent application serial No. 60/212,359, filed on Jun. 19, 2000, (17) U.S. provisional patent application serial No. 60/165,228, filed on Nov. 12, 1999, (18) U.S. provisional patent application serial No. 60/221,443, filed on Jul. 28, 2000, (19) U.S. provisional patent application serial No. 60/221,645, filed on Jul. 28, 2000, (20) U.S. provisional patent application serial No. 60/233,638, filed on Sep. 18, 2000, (21) U.S. provisional patent application serial No. 60/237,334, filed on Oct. 2, 2000, (22) U.S. provisional patent application serial No. 60/270,007, filed on Feb. 20, 2001; (23) U.S. provisional patent application serial No. 60/262,434, filed on Jan. 17, 2001; (24) U.S, provisional patent application serial No. 60/259,486, filed on Jan. 3, 2001; (25) U.S. provisional patent application serial No. 60/303,740, filed on Jul. 6, 2001; (26) U.S. provisional patent application serial No. 60/313,453, filed on Aug. 20, 2001; (27) U.S. provisional patent application serial No. 60/317,985, filed on Sep. 6, 2001; and (28) U.S. provisional patent application serial No. 60/318,386, filed on Sep. 10, 2001, the disclosures of which are incorporated herein by reference.

In several alternative embodiments, the expandable tubular member 220 includes one or more slotted portions to permit the passage of fluidic materials from the interior to the exterior of the expandable tubular member 220. In this manner, production fluids may be conveyed to and from the annular region between the expandable tubular member 220 and the wellbore casing 200.

The sealing members 225 are coupled to the outer surface of the expandable tubular member 220. The sealing members 225 are preferably adapted to fluidicly seal the interface between the radially expanded tubular member 220 and the wellbore casing 200. In this manner, the opening 210 is fluidicly isolated from other sections of the wellbore casing. In a preferred embodiment, the apparatus 215 includes a plurality of sealing members 225, positioned above and below the position of the opening 210 in order to surround and completely fluidicly isolate the opening 210. The sealing members 225 may be any number of conventional sealing members. In a preferred embodiment, the sealing members 225 include one or more reinforcing inner rings 255.

The support member 230 is preferably adapted to be support from above by conventional support members. The support member 230 is further coupled to the expansion cone 235.

The expansion cone 235 is coupled to the support member 230.

The expansion cone 235 is further movably coupled to the expandable tubular member 220. The expansion cone 235 is preferably adapted to radially expand the expandable tubular member 220 when axially displaced relative to the expandable tubular member 220.

The expansion cone 235 is preferably provided as disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, attorney docket no. 25791.9.02, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, attorney docket no. 25791.25.02, filed on Jul. 9, 2000, (11) U.S. provisional patent application serial No. 60/162,671, filed on Nov. 1, 1999, (12) U.S. provisional patent application serial No. 60/154,047, filed on Sep. 16, 1999, (13) U.S. provisional patent application serial No. 60/159,082, filed on Oct. 12, 1999, (14) U.S. provisional patent application serial No. 60/159,039, filed on Oct. 12, 1999, (15) U.S. provisional patent application serial No. 60/159,033, filed on Oct. 12, 1999, (16) U.S. provisional patent application serial No. 60/212,359, filed on Jun. 19, 2000, (17) U.S. provisional patent application serial No. 60/165,228, filed on Nov. 12, 1999, (18) U.S. provisional patent application serial No. 60/221,443, filed on Jul. 28, 2000, (19) U.S. provisional patent application serial No. 60/221,645, filed on Jul. 28, 2000, (20) U.S. provisional patent application serial No. 60/233,638, filed on Sep. 18, 2000, (21) U.S. provisional patent application serial No. 60/237,334, filed on Oct. 2, 2000, (22) U.S. provisional patent application serial No. 60/270,007, filed on Feb. 20, 2001; (23) U.S. provisional patent application serial No. 60/262,434, filed on Jan. 17, 2001; (24) U.S. provisional patent application serial No. 60/259,486, filed on Jan. 3, 2001; (25) U.S. provisional patent application serial No. 60/303,740, filed on Jul. 6, 2001; (26) U.S. provisional patent application serial No. 60/313,453, filed on Aug. 20, 2001; (27) U.S. provisional patent application serial No. 60/317,985, filed on Sep. 6, 2001; and (28) U.S. provisional patent application serial No. 60/318,386, filed on Sep. 10, 2001, the disclosures of which are incorporated herein by reference.

As illustrated in FIG. 2*a*, the apparatus 215 is preferably positioned within the wellbore casing 200 at a predetermined position relative to the opening 210. During placement of the apparatus 215, the expandable tubular member 220 and the support member 230 are preferably support and positioned using conventional support and positioning equipment.

Figure 2B:
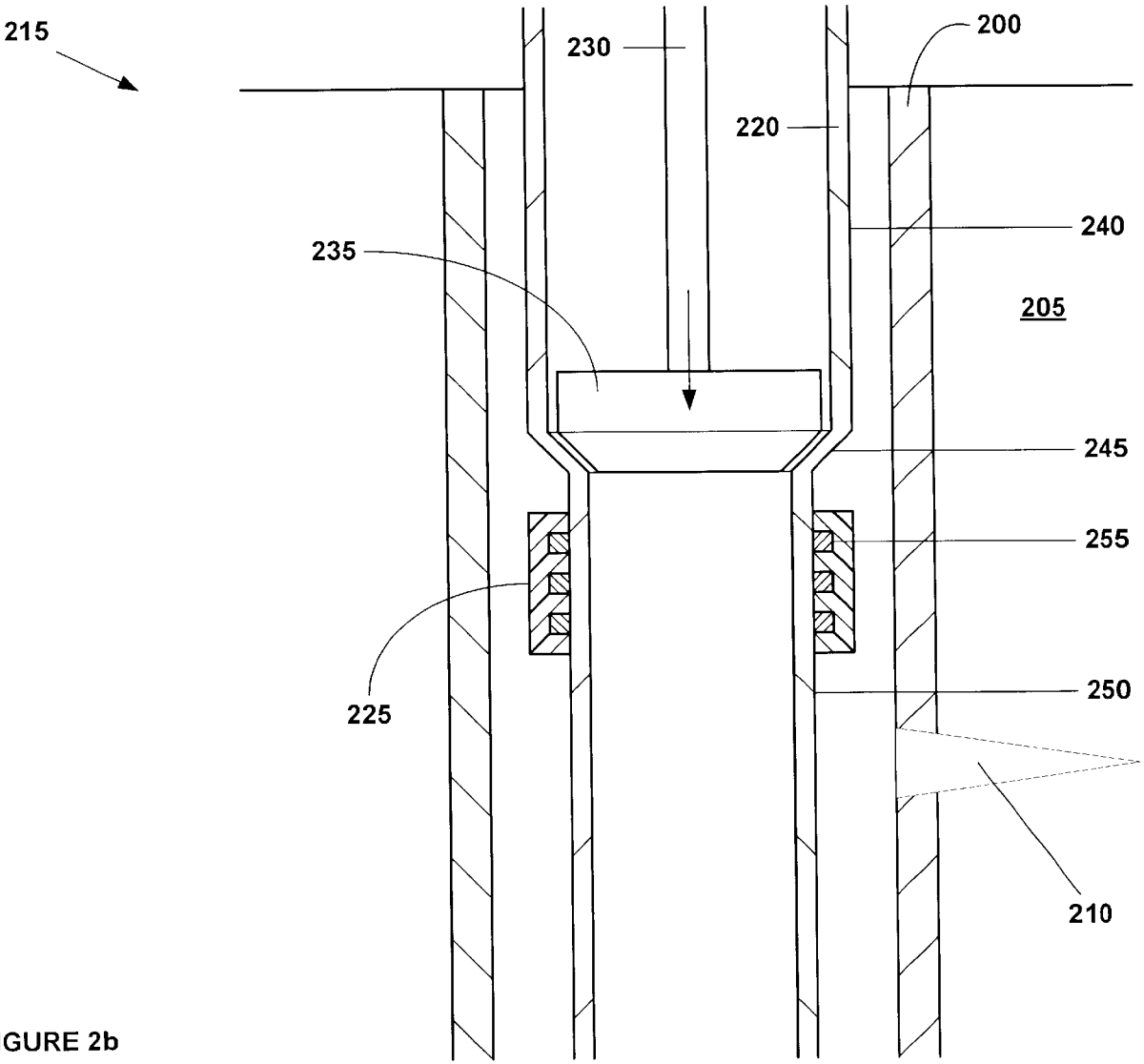
FIG. 2*b* is a fragmentary cross-sectional illustration of the apparatus of FIG. 2*a* after initiating the axial displacement of the expansion cone.

As illustrated in FIG. 2*b*, in a preferred embodiment, the expansion cone 235 is then axially displaced relative to the expandable tubular member 220. In a preferred embodiment, the axial displacement of the expansion cone 235 radially expands the expandable tubular member 220. In a preferred embodiment, the expandable tubular member 220 is radially expanded by about 8 to 40%.

Figure 2C:
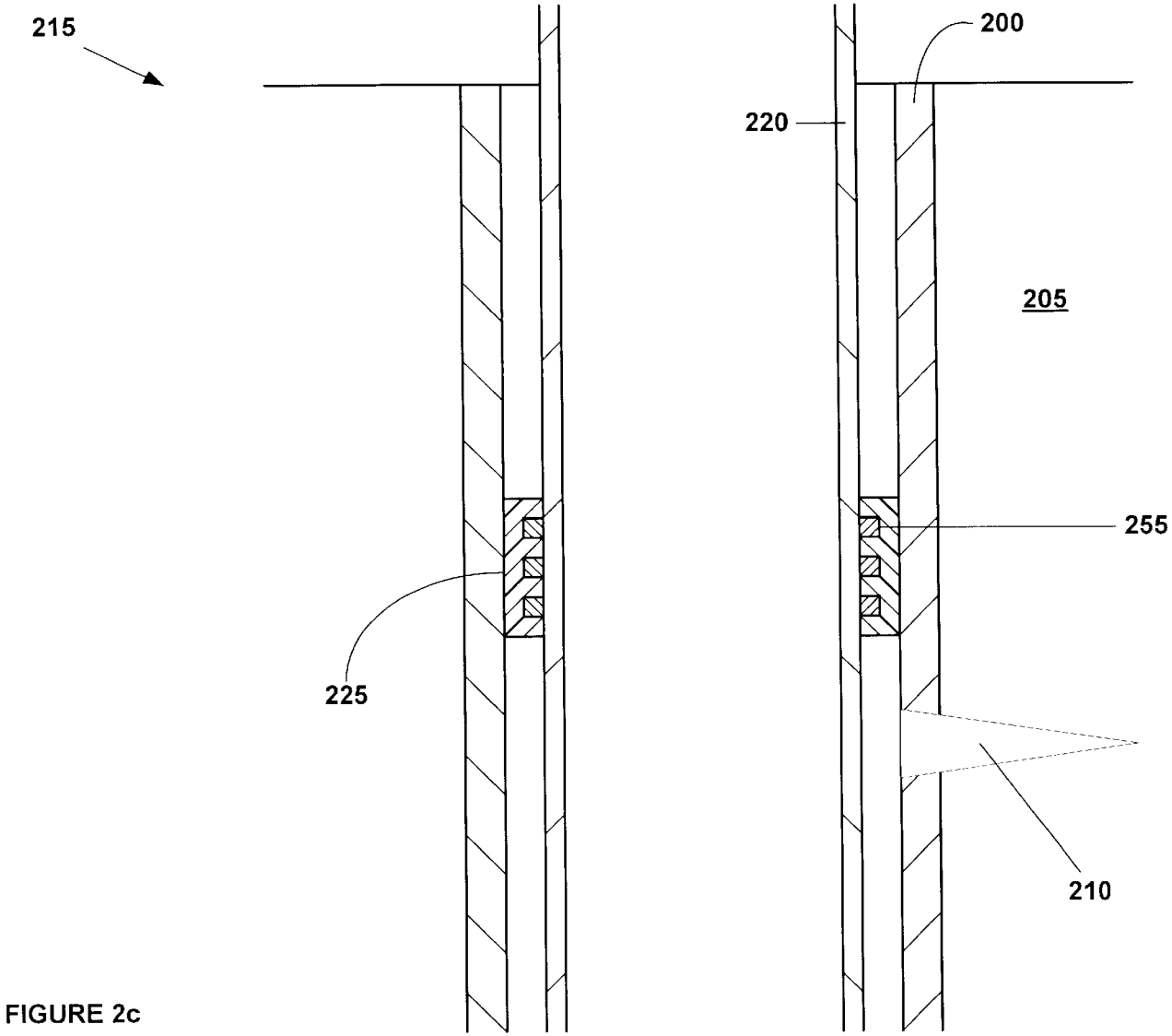
FIG. 2*c* is a fragmentary cross-sectional illustration of the apparatus of FIG. 2*b* after completion of the radial expansion process.

As illustrated in FIG. 2*c*, after completing the radial expansion of the expandable tubular member 220, the annular region between the radially expanded tubular member 220 and the wellbore casing 200 is fluidicly sealed by the sealing members 225. In this manner, the openings 210 are fluidicly isolated from other sections of the wellbore casing 200.

In several alternative embodiments, the expandable tubular member 220 is radially expanded using one or more of the apparatus and methods disclosed in the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, attorney docket no. 25791.16.02, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, attorney docket no. 25791.25.02, filed on Jul. 9, 2000, (11) U.S. provisional patent application serial No. 60/162,671, filed on Nov. 1, 1999, (12) U.S. provisional patent application serial No. 60/154,047, filed on Sep. 16, 1999, (13) U.S. provisional patent application serial No. 60/159,082, filed on Oct. 12, 1999, (14) U.S. provisional patent application serial No. 60/159,039, filed on Oct. 12, 1999, (15) U.S. provisional patent application serial No. 60/159,033, filed on Oct. 12, 1999, (16) U.S. provisional patent application serial No. 60/212,359, filed on Jun. 19, 2000, (17) U.S. provisional patent application serial No. 60/165,228, filed on Nov. 12, 1999, (18) U.S. provisional patent application serial No. 60/221,443, filed on Jul. 28, 2000, (19) U.S. provisional patent application serial No. 60/221,645, filed on Jul. 28, 2000, (20) U.S. provisional patent application serial No. 60/233,638, filed on Sep. 18, 2000, (21) U.S. provisional patent application serial No. 60/237,334, filed on Oct. 2, 2000, (22) U.S. provisional patent application serial No. 60/270,007, filed on Feb. 20, 2001; (23) U.S. provisional patent application serial No. 60/262,434, filed on Jan. 17, 2001; (24) U.S. provisional patent application serial No. 60/259,486, filed on Jan. 3, 2001; (25) U.S. provisional patent application serial No. 60/303,740, filed on Jul. 6, 2001; (26) U.S. provisional patent application serial No. 60/313,053, filed on Aug. 20, 2001; (27) U.S. provisional patent application serial No. 60/317/985, filed on Sep. 6, 2001; and (28) U.S. provisional patent application serial No. 60/318,386, filed on Sep. 10, 2001, the disclosures of which are incorporated herein by reference.

In a preferred embodiment, the ratio of the unexpanded portion of the expandable tubular member 220 to the inside diameter of the wellbore casing 200 ranges from about 8 to 40%. In this manner, the expandable tubular member 220 can be easily positioned within and through collapsed sections of the wellbore casing 200.

In a preferred embodiment, the ratio of the inside diameter of the radially expanded tubular member 220 to the inside diameter of the wellbore casing 200 ranges from about 8 to 40%. In this manner, a large passage is provided within the expanded tubular member 220 for the passage of additional production tools and/or production fluids and gases.

An apparatus has been described that includes one or more primary solid tubulars, n slotted tubulars, n-1 intermediate solid tubulars, and a shoe. Each primary solid tubular includes one or more external annular seals. The slotted tubulars are coupled to the primary solid tubulars. The intermediate solid tubulars are coupled to and interleaved among the slotted tubulars. Each intermediate solid tubular includes one or more external annular seals. The shoe is coupled to one of the slotted tubulars.

A method of isolating a first subterranean zone from a second subterranean zone in a wellbore has been described that includes positioning one or more primary solid tubulars and one or more slotted tubulars within the wellbore. The primary solid tubulars traverse the first subterranean zone and the slotted tubulars traverse the second subterranean zone. The slotted tubulars and the solid tubulars are fluidicly coupled. The passage of fluids from the first subterranean zone to the second subterranean zone within the wellbore external to the solid and slotted tubulars is prevented.

A method of extracting materials from a producing subterranean zone in a wellbore, at least a portion of the wellbore including a casing, has been described that includes positioning one or more primary solid tubulars and one or more slotted tubulars within the wellbore. The primary solid tubulars are fluidicly coupled with the casing. The slotted tubulars traverse the producing subterranean zone. The producing subterranean zone is fluidicly isolated from at least one other subterranean zone within the wellbore. At least one of the slotted tubulars is fluidicly coupled with the producing subterranean zone. In a preferred embodiment, the method further includes controllably fluidicly decoupling at least one of the slotted tubulars from at least one other of the slotted tubulars.

An apparatus has also been described that includes one or more solid tubular members, each solid tubular member including one or more external seals, one or more slotted tubular members coupled to the solid tubular members, a shoe coupled to one of the slotted tubular members, and one or more packers positioned within one or more of the tubular members. Each packer includes: a radially expanded tubular member, and one or more sealing members coupled to the outer surface of the radially expanded tubular member. In a preferred embodiment, the apparatus further includes one or more intermediate solid tubular members coupled to and interleaved among the slotted tubular members, each intermediate solid tubular member including one or more external seals. In a preferred embodiment, the apparatus further includes one or more valve members. In a preferred embodiment, one or more of the intermediate solid tubular members include one or more valve members.

An apparatus has also been described that includes one or more primary solid tubulars, each primary solid tubular including one or more external annular seals, n slotted tubulars coupled to the primary solid tubulars, n-1 intermediate solid tubulars coupled to and interleaved among the slotted tubulars, each intermediate solid tubular including one or more external annular seals, a shoe coupled to one of the slotted tubulars, and one or more packers positioned within one or more of the tubulars. Each packer includes: a radially expanded tubular member, and one or more sealing members coupled to the outer surface of the radially expanded tubular member.

A method of isolating a first subterranean zone from a second subterranean zone in a wellbore has also been described that includes positioning one or more primary solid tubulars within the wellbore, the primary solid tubulars traversing the first subterranean zone, positioning one or more slotted tubulars within the wellbore, the slotted tubulars traversing the second subterranean zone, fluidicly coupling the slotted tubulars and the solid tubulars, preventing the passage of fluids from the first subterranean zone to the second subterranean zone within the wellbore external to the solid and slotted tubulars, and fluidicly isolating one or more annular regions within one or more of the tubulars by the process of: positioning an expandable tubular member having one or more sealing members within the tubular, and radially expanding the expandable tubular member.

A method of extracting materials from a producing subterranean zone in a wellbore, at least a portion of the wellbore including a casing, has also been described that includes positioning one or more primary solid tubulars within the wellbore, fluidicly coupling the primary solid tubulars with the casing, positioning one or more slotted tubulars within the wellbore, the slotted tubulars traversing the producing subterranean zone, fluidicly coupling the slotted tubulars with the solid tubulars, fluidicly isolating the producing subterranean zone from at least one other subterranean zone within the wellbore, fluidicly coupling at least one of the slotted tubulars with the producing subterranean zone, and fluidicly isolating one or more annular regions within one or more of the tubulars by the process of: positioning an expandable tubular member having one or more sealing members within the tubular, and radially expanding the expandable tubular member. In a preferred embodiment, the method further includes controllably fluidicly decoupling at least one of the slotted tubulars from at least one other of the slotted tubulars.

An apparatus for fluidicly isolating annular sections within a wellbore casing has also been described that includes an expandable tubular member adapted to be positioned within the wellbore casing, one or more sealing members coupled to an outside surface of the expandable tubular member, and an expansion cone movably coupled to the expandable tubular member adapted to radially expand the expandable tubular member.

A method of fluidicly isolating annular sections within a wellbore casing has also been described that includes positioning an expandable tubular member having one or more outer sealing members and an expansion cone within the wellbore casing, and axially displacing the expansion cone relative to the expandable tubular member.

A method of fluidicly isolating an annular section of a wellbore casing including a collapsed section has also been described that includes positioning an expandable tubular member having one or more outer sealing members and an expansion cone within the wellbore casing, moving at least a portion of the expandable tubular member through the collapsed section of the wellbore casing, and axially displacing the expansion cone relative to the expandable tubular member.

A packer for sealing an annular region between the packer and a wellbore casing has also been described that includes a radially expanded tubular member and one or more sealing members coupled to the outer surface of the radially expanded tubular member for sealing the annular region between the radially expanded tubular member and the wellbore casing.

A method of operating a packer comprising an expandable tubular member and an annular sealing member coupled to the exterior of the expandable tubular member has also been provided that includes positioning the packer within a subterranean borehole, and radially expanding the expandable tubular member using an expansion cone.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. An apparatus, comprising:

one or more solid tubular members, each solid tubular member including one or more external seals;

one or more slotted tubular members coupled to the solid tubular members;

a shoe coupled to one of the slotted tubular members; and one or more packers positioned within one or more of the tubular members, each packer including:

a radially expanded tubular member; and one or more sealing members coupled to the outer surface of the radially expanded tubular member.

2. The apparatus of claim 1, further comprising;

one or more intermediate solid tubular members coupled to and interleaved among the slotted tubular members, each intermediate solid tubular member including one or more external seals.

3. The apparatus of claim 1, further comprising one or more valve members.

4. The apparatus of claim 2, wherein one or more of the intermediate solid tubular members include one or more valve members.

5. An apparatus, comprising:

one or more primary solid tubulars, each primary solid tubular including one or more external annular seals;

n slotted tubulars coupled to the primary solid tubulars;

n−1 intermediate solid tubulars coupled to and interleaved among the slotted tubulars, each intermediate solid tubular including one or more external annular seals;

a shoe coupled to one of the slotted tubulars; and one or more packers positioned within one or more of the tubulars, each packer including:

a radially expanded tubular member; and one or more sealing members coupled to the outer surface of the radially expanded tubular member.

6. A method of isolating a first subterranean zone from a second subterranean zone in a wellbore, comprising:

positioning one or more primary solid tubulars within the wellbore, the primary solid tubulars traversing the first subterranean zone;

positioning one or more slotted tubulars within the wellbore, the slotted tubulars traversing the second subterranean zone;

fluidicly coupling the slotted tubulars and the solid tubulars;

preventing the passage of fluids from the first subterranean zone to the second subterranean zone within the wellbore external to the solid and slotted tubulars; and fluidicly isolating one or more annular regions within one or more of the tubulars by the process of:

positioning an expandable tubular member having one or more sealing members within the tubular; and radially expanding the expandable tubular member.

7. A method of extracting materials from a producing subterranean zone in a wellbore, at least a portion of the wellbore including a casing, comprising;

positioning one or more primary solid tubulars within the wellbore;

fluidicly coupling the primary solid tubulars with the casing;

positioning one or more slotted tubulars within the wellbore, the slotted tubulars traversing the producing subterranean zone;

fluidicly coupling the slotted tubulars with the solid tubulars;

fluidicly isolating the producing subterranean zone from at least one other subterranean zone within the wellbore;

fluidicly coupling at least one of the slotted tubulars with the producing subterranean zone; and fluidicly isolating one or more annular regions within one or more of the tubulars by the process of:

positioning an expandable tubular member having one or more sealing members within the tubular; and radially expanding the expandable tubular member.

8. The method of claim 7, further comprising:

controllably fluidicly decoupling at least one of the slotted tubulars from at least one other of the slotted tubulars.

9. An apparatus, comprising:

one or more first tubular members that do not permit fluidic materials to pass therethrough in a radial direction, each first tubular member including one or more external seals;

one or more second tubular members that do permit fluidic materials to pass therethrough in a radial direction coupled to the first tubular me a shoe coupled to one of the second tubular members; and one or more packers positioned within one or more of the first an members, each packer including:

a radially expanded tubular member; and one or more sealing members coupled to the outer surface of the radially expanded tubular member.

10. The apparatus of claim 9, further comprising;

one or more third tubular members coupled to and interleaved among the second tubular members, each third tubular member including one or more external seals.

11. The apparatus of claim 9, further comprising one or more valve members operably coupled to one or more of the first and second tubular members.

12. The apparatus of claim 10, wherein one or more of the third tubular members include one or more valve members.

13. An apparatus, comprising:

one or more first tubular members that do not permit fluidic materials to pass therethrough in a radial direction, each first tubular member including one or more external annular seals;

n second tubular members that do permit fluidic materials to pass therethrough in a radial direction coupled to the first tubular members;

n−1 third tubular members coupled to and interleaved among the second tubular members, each third tubular member including one or more external annular seals;

a shoe coupled to one of the second tubular members; and one or more packers positioned within one or more of the first, second, and third tubular members, each packer including:

a radially expanded tubular member; and one or more sealing members coupled to the outer surface of the radially expanded tubular member.

14. A method of isolating a first subterranean zone from a second subterranean zone in a wellbore, comprising:

positioning one or more first tubular members that do not permit fluidic materials to pass therethrough in a radial direction within the wellbore, the first tubular members traversing the first subterranean zone;

positioning one or more second tubular members that do permit fluidic materials to pass therethrough in a radial direction within the wellbore, the second tubular members traversing the second subterranean zone;

fluidicly coupling the first and second tubular members;

preventing the passage of fluids from the first subterranean zone to the second subterranean zone within the wellbore external to the first and second tubular members; and fluidicly isolating one or more annular regions within one or more of the first and second tubular members by the process of:

positioning an expandable tubular member having one or more sealing members within one of the first and second tubular members; and radially expanding the expandable tubular member.

15. A method of extracting materials from a producing subterranean zone in a wellbore, at least a portion of the wellbore including a casing, comprising;

positioning one or more first tubular members that do not permit fluidic materials to pass therethrough in a radial direction within the wellbore;

fluidicly coupling the first tubular members with the casing;

positioning one or more second tubular members that do permit fluidic materials to pass therethrough in a radial direction within the wellbore, the second tubular members traversing the producing subterranean zone;

fluidicly coupling the first and second tubular members;

fluidicly isolating the producing subterranean zone from at least one other subterranean zone within the wellbore;

fluidicly coupling at least one of the second tubular members with the producing subterranean zone; and fluidicly isolating one or more annular regions within one or more of the first and second tubular members by the process of:

positioning an expandable tubular member having one or more sealing members within one of the first and second tubular members; and radially expanding the expandable tubular member.

16. The method of claim 15, further comprising:

controllably fluidicly decoupling at least one of the second tubular members from at least one other of the second tubular members.

17. An apparatus, comprising:

one or more first tubular members that do not permit fluidic materials to pass therethrough in a radial direction;

one or more second tubular members that do permit fluidic materials to pass therethrough in a radial direction coupled to the first tubular members; and a shoe coupled to one of the second tubular members;

wherein at least one of the first and second tubular members is radially expanded and plastically deformed.

18. The apparatus of claim 17, wherein the first and second tubular members are radially expanded and plastically deformed.

19. The apparatus of claim 17, wherein at least one of the first and second tubular members are radially expanded and plastically deformed into intimate contact with another structure.

20. The apparatus of claim 17, further comprising;

one or more third tubular members coupled to and interleaved among the second tubular members, each third tubular member including one or more external seals.

21. The apparatus of claim 17, further comprising one or more valve members operably coupled to at least one of the first and second tubular members.

22. The apparatus of claim 20, wherein one or more of the third tubular members include one or more valve members.

23. An apparatus, comprising:

one or more first tubular members that do not permit fluidic materials to pass therethrough in a radial direction, each first tubular member including one or more external annular seals;

n second tubular members that do permit fluidic materials to pass therethrough in a radial direction coupled to the first tubular members;

n−1 third tubular members coupled to and interleaved among the second tubular members, each third tubular member including one or more external annular seals; and a shoe coupled to one of the second tubular members;

wherein at least one of the first, second, and third tubular members are radially expanded and plastically deformed.

24. The apparatus of claim 23, wherein the first, second, and third tubular members are radially expanded and plastically deformed.

25. The apparatus of claim 23, wherein at least one of the first, second, and third tubular members are radially expanded and plastically deformed into intimate contact with another structure.

26. A method of isolating a first subterranean zone from a second subterranean zone in a wellbore, comprising:

positioning one or more first tubular members that do not permit fluidic materials to pass therethrough in a radial direction within the wellbore, the first tubular members traversing the first subterranean zone;

positioning one or more second tubular members that do permit fluidic materials to pass therethrough in a radial direction within the wellbore, the second tubular members traversing the second subterranean zone;

fluidicly coupling the first and second tubular members;

preventing the passage of fluids from the first subterranean zone to the second subterranean zone within the wellbore external to the first and second tubular members; and radially expanding and plastically deforming at least one of the first and second tubular members within the wellbore.

27. The method of claim 26, wherein the first and second tubular members are radially expanded and plastically deformed within the wellbore.

28. The method of claim 26, wherein at least one of the first and second tubular members are radially expanded and plastically deformed into intimate contact with the wellbore.

29. The method of claim 26, wherein at least one of the first and second tubular members are radially expanded and plastically deformed into intimate contact with the casing.

30. A method of extracting materials from a producing subterranean zone in a wellbore, at least a portion of the wellbore including a casing, comprising;

positioning one or more first tubular members that do not permit fluidic materials to pass therethrough in a radial direction within the wellbore;

fluidicly coupling the first tubular members with the casing;

positioning one or more second tubular members that do permit fluidic materials to pass therethrough within the wellbore, the second tubular members traversing the producing subterranean zone;

fluidicly coupling the first and second tubular members;

fluidicly isolating the producing subterranean zone from at least one other subterranean zone within the wellbore;

fluidicly coupling at least one of the second tubular members with the producing subterranean zone; and radially expanding and plastically deforming at least one of the first and second tubular members within the wellbore.

31. The method of claim 30, wherein the first and second tubular members are radially expanded within the wellbore.

32. The method of claim 30, wherein at least one of the first and second tubular members are radially expanded and plastically deformed into intimate contact with the wellbore.

33. The method of claim 30, wherein at least one of the first and second tubular members are radially expanded and plastically deformed into intimate contact with the casing.

34. The method of claim 30, further comprising:

controllably fluidicly decoupling at least one of the second tubular members from at least one other of the second tubular members.

35. An apparatus, comprising:

one or more first tubular members that do not permit fluidic materials to pass therethrough in a radial direction, each solid tubular member including one or more external seals;

one or more second tubular members that do permit fluidic materials to pass therethrough in a radial direction coupled to the first tubular members;

a shoe coupled to one of the second tubular members; and one or more packers positioned within one or more of the first and second tubular members.

36. An apparatus, comprising:

one or more first tubular members that do not permit fluidic materials to pass therethrough in a radial direction, each first tubular member including one or more external annular seals;

n second tubular members that do permit fluidic materials to pass therethrough in a radial direction coupled to the first tubular members;

n−1 third tubular members coupled to and interleaved among the second tubular members, each third tubular member including one or more external annular seals;

a shoe coupled to one of the second tubular members; and one or more packers positioned within one or more of the first, second, and third tubular members.

37. A method of isolating a first subterranean zone from a second subterranean zone in a wellbore, comprising:

positioning one or more first tubular members that do not permit fluidic materials to pass therethrough in a radial direction within the wellbore, the first tubular members traversing the first subterranean zone;

positioning one or more second tubular members that do permit fluidic materials to pass therethrough in a radial direction within the wellbore, the second tubular members traversing the second subterranean zone;

fluidicly coupling the first and second tubular members;

preventing the passage of fluids from the first subterranean zone to the second subterranean zone within the wellbore external to the first and second tubular members; and fluidicly isolating one or more annular regions within one or more of the first and second tubular members by the process of:

installing a packer within one of the first and second tubular members.

38. A method of extracting materials from a producing subterranean zone in a wellbore, at least a portion of the wellbore including a casing, comprising;

positioning one or more first tubular members that do not permit fluidic materials to pass therethrough in a radial direction within the wellbore;

fluidicly coupling the first tubular members with the casing;

positioning one or more second tubular members that do permit fluidic materials to pass therethrough in a radial direction within the wellbore, the second tubular members traversing the producing subterranean zone;

fluidicly coupling the first and second tubular members;

fluidicly isolating the producing subterranean zone from at least one other subterranean zone within the wellbore;

fluidicly coupling at least one of the second tubular members with the producing subterranean zone; and fluidicly isolating one or more annular regions within one or more of the first and second tubular members by the process of:

installing a packer within one of the first and second tubular members.

39. A system for extracting materials from a producing subterranean zone within a wellbore, at least a portion of the wellbore including a casing, comprising:

one or more first tubular members that do not permit fluidic materials to pass therethrough in a radial direction positioned within the wellbore and coupled to the casing;

one or more second tubular members that permit fluidic materials to pass therethrough in a radial direction positioned within the wellbore and coupled to the first tubular members, at least one of the second tubular members traversing the producing subterranean formation;

one or more sealing members coupled to the second tubular members; and a shoe coupled to the second tubular members;

wherein at least one of the first tubular members is radially expanded and plastically deformed within the wellbore into sealing engagement with the casing;

wherein at least one of the second tubular members is radially expanded and plastically deformed within the wellbore; and wherein at least one of the sealing members is radially expanded within the wellbore into sealing engagement with the wellbore.

40. A method of extracting materials from a producing subterranean zone in a wellbore, at least a portion of the wellbore including a casing, comprising;

positioning one or more first tubular members that do not permit fluidic materials to pass therethrough in a radial direction within the wellbore;

fluidicly coupling the first tubular members with the casing;

positioning one or more second tubular members that do permit fluidic materials to pass therethrough in a radial direction within the wellbore, at least one of the second tubular members traversing the producing subterranean zone;

fluidicly coupling the first and second tubular members;

fluidicly isolating the producing subterranean zone from at least one other subterranean zone within the wellbore; and fluidicly coupling at least one of the second tubular members with the producing subterranean zone.

* * * * *

UNITED STATES PATENT AND TRADEMARK OFFICE

CERTIFICATE OF CORRECTION

PATENT NO. : 6,712,154 B2
DATED : March 30, 2004
INVENTOR(S) : Robert Lance Cook et al.

It is certified that error appears in the above-identified patent and that said Letters Patent is hereby corrected as shown below:

Column 14,
Line 35, change "tion coupled to the first tubular me" to -- tion coupled to the first tubular members; --.

Signed and Sealed this

Twentieth Day of July, 2004

JON W. DUDAS
*Acting Director of the United States Patent and Trademark Office*